United States Patent [19]

Körner

[11] 4,016,786

[45] Apr. 12, 1977

[54] METHOD OF AND APPARATUS FOR STAMPING OUT SHEET MATERIAL BLANKS

[75] Inventor: Siegfried Körner, Dresden, Germany

[73] Assignee: VEB polygraph Leipzig Kombinat fur Polygraphische Maschinen und Ausrustungen, Leipzig, Germany

[22] Filed: Dec. 16, 1974

[21] Appl. No.: 533,168

[30] Foreign Application Priority Data

Dec. 17, 1973 Germany ..... 3117537

[52] U.S. Cl. ..... 83/9; 83/37; 83/100; 83/343; 83/347; 83/663; 83/670; 93/58.2 R; 226/30

[51] Int. Cl.[2] ..... B26D 3/08; B26D 1/56

[58] Field of Search ..... 83/7, 8, 9, 100, 343, 83/346, 347, 37, 38, 505, 506, 663, 669, 670, 673, 674, 675; 93/36 A, 58.2 R, 58.2 F, 58.5, 59 ES; 226/30, 31

[56] References Cited

UNITED STATES PATENTS

| | | | |
|---|---|---|---|
| 1,865,302 | 6/1932 | Cameron | 83/505 X |
| 2,206,138 | 7/1940 | Tuttle et al. | 83/37 X |
| 3,188,900 | 6/1965 | Mauro | 83/663 |
| 3,347,119 | 10/1967 | Sarka | 83/38 |
| 3,479,931 | 11/1969 | Bishop | 83/663 X |
| 3,552,281 | 1/1971 | Feick | 93/58.2 R |
| 3,570,355 | 3/1971 | Spengler | 83/663 |
| 3,760,671 | 9/1973 | Jenkins | 83/347 X |
| R27,139 | 6/1971 | Sarka | 83/38 |

*Primary Examiner*—Othell M. Simpson
*Assistant Examiner*—W. D. Bray
*Attorney, Agent, or Firm*—Michael J. Striker

[57] ABSTRACT

A sheet material is advanced to a first location where cutting tools cut into it but not through it along the outline of the desired blank. Thereupon the sheet material and the cutting tools are jointly advanced to a second location where the cutting tools cut completely through the sheet material along the outline, and subsequently the thus-severed blank and the surrounding sheet material scrap are removed separately from the second location.

7 Claims, 4 Drawing Figures

METHOD OF AND APPARATUS FOR STAMPING OUT SHEET MATERIAL BLANKS

BACKGROUND OF THE INVENTION

The present invention relates generally to the manufacturing of blanks from sheet material, such as blanks for folded boxes, labels and the like. More particularly, the invention relates to a method of stamping out sheet material blanks and to an apparatus for carrying out the method. Still more particularly, the invention relates to such a method and apparatus for carrying out the stamping of sheet material blanks in a continuous manner.

The manufacture of sheet material blanks by stamping them out of sheet material is well known, and it is also known how to do this continuously. The prior-art devices include a type wherein a cutting or stamping roller is provided that has cutting edges on its circumference and cooperates with a counter roller. The two rollers form with one another a nip and the sheet material from which the blanks are to be stamped is moved in a straight line through the nip so that the cutting edges on the cutting roller cut through the sheet material all the way into engagement with the hard surface of the cooperating counter roller. Because of the straight line movement of the sheet material through the nip of the two rollers the surface of the sheet material comes in contact with the cutting edges only when the same engage it and press it against the surface of the cooperating counter roller. The stamping-out of blanks from the sheet material (whether the same be of single-sheet configuration or in form of an elongated web or strip) progresses in direction opposite to the advancement of the sheet material; i.e. the respectively leading portion of the sheet material is always cut apart as the blanks are stamped from it, whereas the portion or portions of the sheet material which are approaching the nip between the rollers have not yet been touched. During the actual cutting operation, that is at the time at which the cutting edges penetrate into the sheet material, the speed of movement of the cutting edge tip does not equal the speed of advancement of the sheet material at the point of contact thereof with the cutting edge tip, due to the rotary movement of the cutting roller. These differences in the speed may be minor, but they are sufficient to assure that during the penetration of the cutting edge through the sheet material there will be sufficient relative movement of the sheet material and the penetrating cutting edge to cause crinkling or otherwise deforming of the sheet material along the cut that is being made.

Another type of prior-art apparatus utilizes the same principle of a rotary cutting roller having cutting edges and a hard-surfaced counter roller, but in this construction the sheet material from which the blanks are to be stamped engages the circumference of the counter roller and is supplied to the nip between the two rollers in an arcuate path rather than in a straight-line path. The two rollers are connected by a set of gears to assure that they are rotated in such a manner that the surface of the counter roller and the tips of the cutting blades will have identical angular velocities. In such a machine that side of the sheet material from which the blanks are to be stamped which engages the surface of the counter roller travels at the angular velocity of this surface; hence, since the cutting edges cut through the sheet material into engagement with the surface of the counter roller the same problems will occur which have been described above with the other type of prior-art equipment.

Moreover, these two types of prior-art apparatus have further disadvantages beyond those which have already been outlined.

It has been found that it is only theoretically possible to obtain a 100% severing of the sheet material blank from the surrounding sheet material with this type of equipment. Due to the differential wear of the cutting edges, nicks in the cutting edges, manufacturing tolerances of the cutting roller having the cutting edges, out-of-round configurations of the two rollers, deformations of the rollers and surface damage to the counter roller, to name the most frequent occurrences, it is in actual practice impossible to obtain a 100% severance of the blanks from the sheet material. This means that because of this the blank will continue to adhere to the surroundng sheet material by way of fibers which have not been fully severed and which interfere with the subsequent separation of the blanks from the sheet material.

Another disadvantage is that there must be a prestress in the operation of this type of machine, that is a force at which all of the cutting edges that are in engagement with the sheet material at any one time are pressed against the sheet material and against the hard surface of the counter roller. Only in this manner is it possible to obtain any severing at all. However, this prestress means that the cutting edges engage the hard surface of the counter roller with sufficient force to undergo rapid wear, especially insofar as the longitudinally extending cutting edges are concerned which wear away more rapidly than the transversely extending ones, it having been found that the specific forces which act upon the longitudinally extending cutting edges are higher than those acting upon the transversely extending ones. This wear of the cutting edges requires correction by way of an increase of the prestress in order to obtain a cutting of the edges through the sheet material despite the wear. The increase in the prestress, however, leads to a further increase in the wear. This cycle is repeated until, after a very short period of time, the cutting edges are so blunt that they must be renewed since any further increase in the prestress will not cause them to penetrate through the sheet material any longer. Finally, this type of equipment also requires devices for increasing the prestress to compensate for wear.

Another type of prior-art apparatus uses a cutting roller as mentioned before, but employs a counter roller having a relatively soft and yieldable surface. In this case, the cutting edges penetrate the sheet material and sever it at their point of contact with the yieldable surface of the counter roller, pressing the sheet material against and to some extent into the yieldable surface of the counter roller until the resistance of the surface to further deformation becomes so great that the actual severing of the sheet material occurs.

With this type of equipment it is theoretically possible to obtain a 100% cut-through of the sheet material. The yielding of the surface of the counter roller tends to compensate for the differential wear of the cutting edges, and also for manufacturing tolerances and out-of-round conditions of the two rollers. However, practical experience has shown that nicks and similar flaws in the cutting edges are not compensated-for so that the presence of residual fibers which connect the blank with the surrounding sheet material scrap, continues to remain a problem even in this type of equipment. Moreover, such fibers also remain when the restoring force of the yieldable surface of the counter roller is not sufficient to press back hard enough against the cutting edges to assure that the latter penetrate relatively harder portions of the sheet material, for instance a small wood chip that might be imbedded in the sheet material. The problems outlined above with respect to the separation of the blanks from the surrounding sheet material scrap therefore continue to exist in this type of equipment, as they do in the earlier-mentioned machines. Moreover, during the actual cutting operation the cutting edge tends to press the sheet material so far into the elastically yieldable surface of the counter roller until the resistance of this surface to yielding has become high enough so that the actual cutting operation will take place. This, however, produces an unclean cut (e.g. a fuzzy or crinkly edge) which makes it impossible to use this type of machine where sharp clean edges are required to be produced on the blank.

In all of this equipment that has been mentioned the sheet material always has the blank or blanks stamped out at its leading regions, whereas the trailing regions (the ones which are approaching the nip between the rollers) have not yet been touched by the cutting edges. The differences in the angular speed between the cutting edges and the advancing material cause the aforementioned formation of ruffles or the like at the cut edges. After the cut the cutting edges immediately are withdrawn from the sheet material and move away from the same. For this reason there is no guarantee that all blanks will be of exactly identical size because not all of the cutting edges participating in the cutting or stamping-out of a blank penetrate the sheet material at one and the same time. The fact that the sheet material approaching the nip between the rollers is as yet untouched, whereas in the nip and downstream of the nip the sheet material has already had blanks stamped out of it means that the structural integrity of the sheet material is highly unstable so that, as the sheet material with the almost but not completely severed blanks is subsequently advanced into a device for pushing the blanks out, great difficulties are experienced in guiding the sheet material into this device, especially where the operation takes place at high speeds as is always the case with rotating cutting rollers, and where large sheet-material formats are involved.

SUMMARY OF THE INVENTION

Accordingly, it is an object of the present invention to overcome the disadvantages of the prior art.

More particularly, it is an object of this invention to provide an improved method of stamping out sheet material blanks.

Another object is to provide an improved apparatus for carrying out the novel method.

A further object is to provide such a method and apparatus wherein the wear on the cutting edges will be significantly decreased as compared to the prior art.

A concomitant object is to provide such a method and apparatus wherein cuts performed will have neat and clean edges and wherein no deviation will occur in the size of the individual blanks.

Still another object of the invention is to provide such a method and apparatus wherein an increase in productivity is obtained.

In keeping with these objects, and with others which will become apparent hereafter, one feature of the invention resides in a method of stamping out sheet material blanks which, briefly stated, comprises the steps of advancing a sheet material to a first location, cutting into the sheet material with cutting tools along the outline of the desired blank, and thereupon advancing the sheet material and cutting tools jointly to a second location. At this second location the cutting tools cut completely through the sheet material along the aforementioned outline, and the severed blank and the surrounding scrap will then be separately removed.

Thus, by dividing the operation into two major operating sequences there is obtained a precise physical separation of sheet material blanks and scrap from which they have been severed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
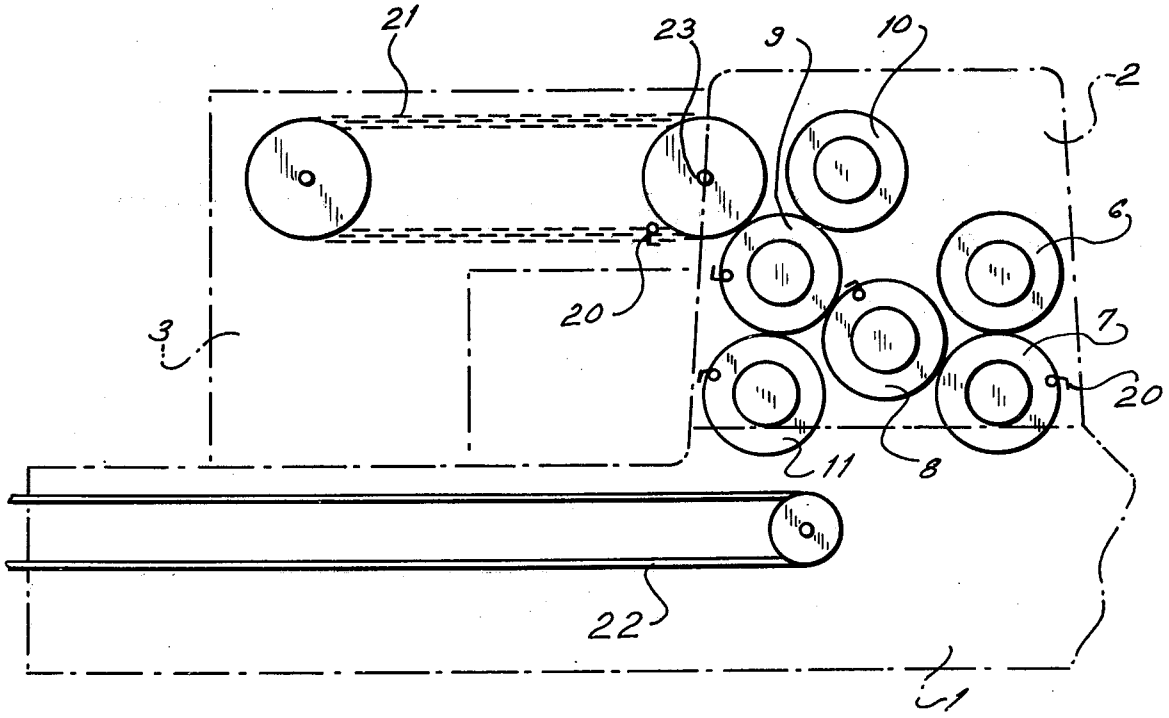
FIG. 1 is a highly diagrammatic side view illustrating an apparatus according to the present invention.
Figure 3:
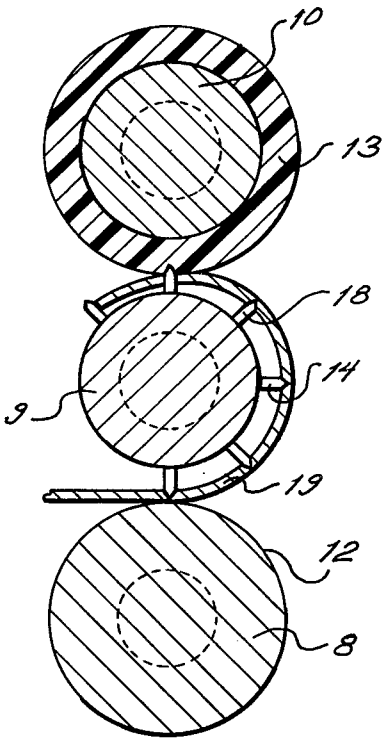
FIG. 3 is a section taken on line III—III of FIG. 2.
Figure 2:
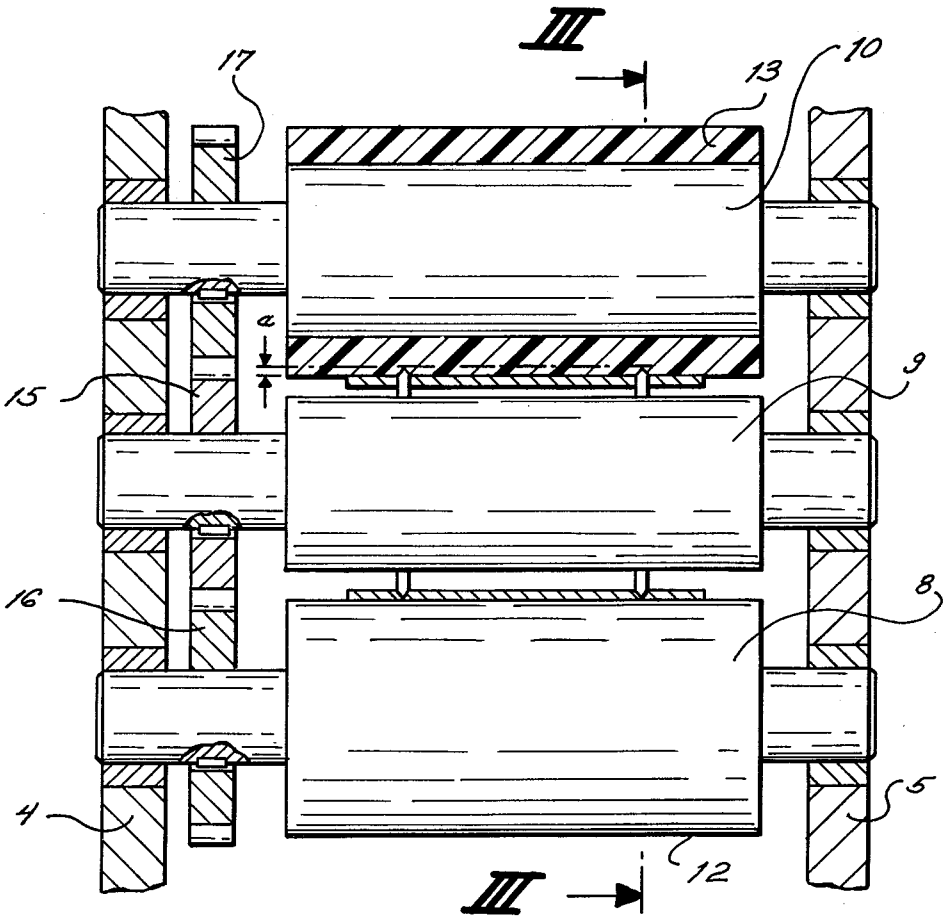
FIG. 2 is a somewhat diagrammatic partly section view showing the cooperation of the sheet material-handling rollers of the apparatus in FIG. 1.
Figure 4:
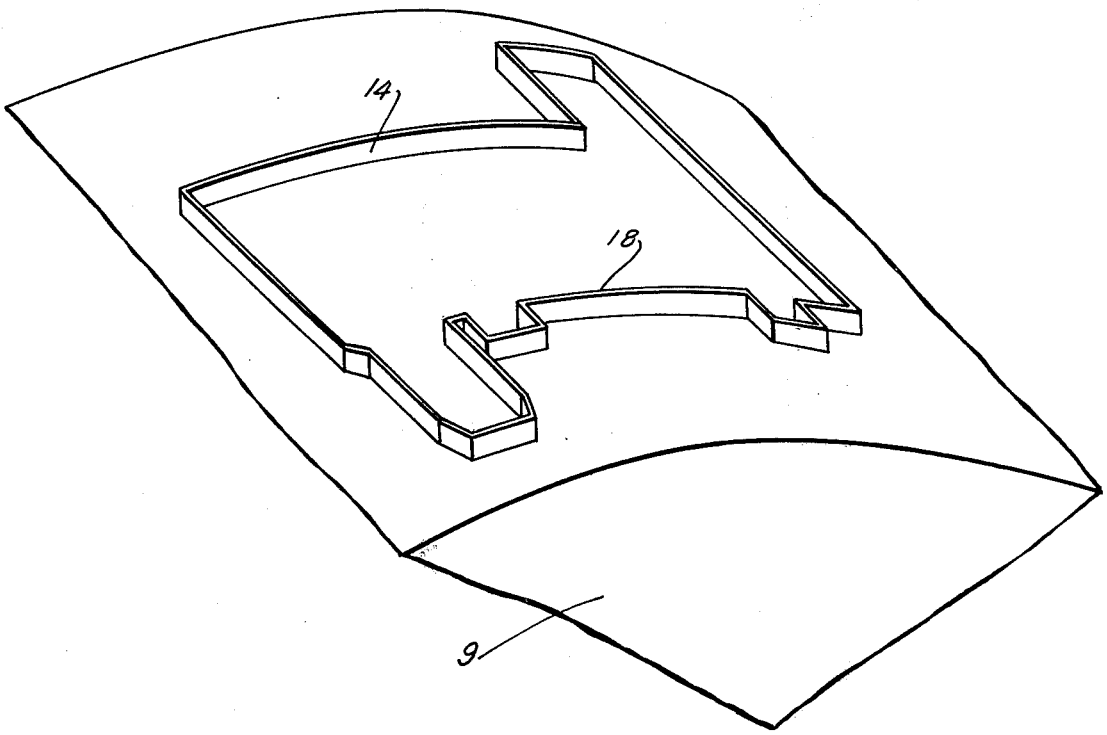
FIG. 4 is a fragmentary perspective showing details of the blade structure of FIG. 3.

DESCRIPTION OF THE PREFERRED EMBODIMENTS:

FIGS. 1–4 illustrate a single exemplary embodiment of the invention. The machine is illustrated in detail only insofar as is necessary for an understanding of the invention. For example, details of the journalling of the rollers or of the manner in which they are driven, are not illustrated because these are entirely conventional.

With this in mind it will be seen that reference numerals 1 and 3 identify the upper and lower portions of a machine frame on which the operating unit 2 is mounted. The unit 2 has sidewalls 4 and 5 between which (and journalled for rotation in which) there are mounted a sheet material grooving cylinder 7, a counter roller for stamping identified with reference numeral 8, a counter roller 6 for grooving that cooperates with the roller 7, the stamping roller 9 which cooperates with the roller 8, counter roller 10 which also cooperates with the roller 8, and a suction cylinder 11.

The roller 8 has a hard circumferential surface 12 whereas the roller 10 has a resiliently deformable circumferential surface 13. This surface 13 of the roller 10 may for example be of soft steel, copper, brass, aluminum or synthetic plastic material. The entire roller 10 may be of such material, or the roller 10 may be provided only with a surface layer of such material which forms the surface 13.

The circumference of the roller 9 carries cutting blades 14 which in the illustrated embodiment have cutting edges 18 that are tapered from both sides towards the tip and have a height *a* which is the dimension by which the tapered sharp edge or tip projects from the remainder of the respective blade 14. The tips 18 rotate on and with the cylinder 9 at the same peripheral speed as the hard surface 12 of the counter roller 8, a fact which is assured in that the roller 9 is in driving connection with the roller 8 by engagement of the gear 15 which is mounted on the shaft of the roller 9 and the gear 16 which is mounted on the shaft of the roller 8. The diameter of the roller 9, measured over the tips 18 of the blades 14, equals the diameter of the gear 15 whereas the diameter of the roller 8 equals the diameter of the gear 16.

The second counter roller 10 is similarly connected in driving connection with the roller 9, by engagement of the gear 17 which is mounted on the shaft of the roller 10 with the gear 15 on the shaft of the roller 9. The arrangement here is such that the peripheral speed of the yieldable surface 13 of the roller 10 is slightly greater than the peripheral speed of the tips 18 on the blades 14 of the roller 9. To obtain this, the diameter of the cylinder 10 is greater by twice the dimension *a* than the diameter of the gear 17.

The sheet material 19 (see FIG. 3) from which blanks are to be stamped may be supplied to the apparatus either in the form of individual sheets or in form of a continuous web. It is first supplied in conventional manner (and which is therefore not illustrated) to the grooving roller 7 where it is engaged by grippers 20 and made to pass between the grooving roller 7 and the counter roller 6 thereof so as to be formed with grooves. Thereafter, the sheet material 19 is supplied via the counter roller 8 to the cutting or stamping roller 9. The relative positions of the rollers 8 and 9 are such that the tips 18 of the blade 14 can never do more than at most very slightly touch the hard surface 12 of the roller 8, but not sufficiently so for them to become blunted or otherwise damaged.

During the stamping operation which is performed by cooperation of the cylinders 8 and 9 the sheet material 19 is pressed by the tips 18 against the surface 12 of the roller 8 and the material of the blank being stamped out becomes located between the tips 18 which have penetrated into the sheet material 19. This means that the sheet material 19 is at rest with reference to the blades 14 of the roller 9 as it travels with the latter towards the counter roller 10. The surface 13 of the counter roller 10 is slightly yieldable and in effect pushes the sheet material 19 somewhat more deeply between the blades 14 on the roller 9, by a distance which in the exemplary embodiment is identified with reference character *a*, that is the depth or height of the cutting edges 18. This means, conversely, that the cutting edges 18 penetrate by the amount *a* into the surface 13 of the roller 10.

As in the prior art, residual connecting fibers will have remained at the time at which the cutting edges 18 have cut into the sheet material 19 in cooperation with the surface 12 of the roller 8; these fibers continue to link the blank with the surrounding sheet material scrap. However, unlike the prior art, these residual fibers will be torn completely as the tips 18 of the blades 14 penetrate into the surface 13 of the roller 10, which surface then at the same time pushes the sheet material 19 deeper between the blades 14. The blank is now completely severed from the surrounding sheet material scrap. But the scrap and the blank are addressed relative to the rotating roller 9 and are physically separated from one another by the tips 18 which are interposed between them.

After the separation of the blank from the sheet material scrap has thus taken place by cooperation of the rollers 9 and 10, grippers 20 mounted on endless chains 21 (see FIG. 1) engage an edge of the sheet material 19 and the scrap (which has the form of a lattice out of which the blanks have been stamped) is pulled out from between the blades 14 and is removed from the machine. The blanks themselves, which are still located within the confines of the blades 14 which have served to stamp out the respective blank, are withdrawn by the suction cylinder 11 which is of known construction and operation, and are deposited in form of an overlapping stream on a conveyor belt 22 which removes them from the machine physically separate from the scrap being removed.

It is clear that the present invention, which has above been described with respect both to its method aspects and to an exemplary embodiment of the apparatus, achieves its intended purposes. Aside from overcoming all of the disadvantages outlined above with respect to the prior art, the present invention also simplifies the construction of the equipment since it eliminates the need for a separate device which punches the incompleted blanks out of the sheet material scrap. Not only does this result in a less expensive construction and therefore in a decrease of the economic investment required for the apparatus, but also it eliminates the energy requirements of such a separate device, the necessity for an operator to supervise this device at least on a part-time basis, and the difficulties that occur if such a device malfunctions and then causes of necessity a shut-down of the entire machine.

It will be understood that each of the elements described above, or two or more together, may also find a useful application in other types of constructions differing from the types described above.

While the invention has been illustrated and described as embodied in an apparatus for stamping out blanks from sheet material, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention.

I claim:

1. A method of stamping out sheet material blanks, comprising the first step of advancing a sheet material to a first location; the second step of cutting only partly through the sheet material with cutting tools along the outline of the desired blank; the third step of advancing the sheet material and cutting tools without displacement of said sheet material and cutting tools relative to each other jointly to a second location; the fourth step of cutting completely through the sheet material along said outline at the second location; and the fifth step of removing the severed blank and the surrounding scrap separately from one another.

2. A method as defined in claim 1, wherein said fourth step comprises urging said sheet material with a resiliently yieldable surface against said cutting tools, so that the same penetrate through said sheet material and into said surface.

3. Apparatus for stamping out sheet material blanks, comprising first means for cutting into a sheet material at a first location along the outlines of a blank to be stamped, and for advancing with the sheet material thereafter to a second location, said first means comprising a cutting roller having a periphery provided with cutting edges and a hard-surfaced counter roller cooperating with said cutting edges; second means cooperating at said second location with said first means for completely severing said blank from the surrounding sheet material, said second means comprising a soft-surfaced additional counter roller which cooperates with said cutting edge at a location circumferentially spaced from said hard-surfaced counter roller; and third means for removing the blank and the surrounding sheet material from one another.

4. Apparatus as defined in claim 3, wherein said hard-surfaced counter roller is so arranged relative to said cutting roller that said cutting edges at most contact but do not exert any cutting action upon the periphery of said hard-surfaced counter roller.

5. Apparatus as defined in claim 4, wherein said additional counter roller is so arranged relative to said cutting roller that said cutting edges penetrate into the periphery of said additional counter roller.

6. Apparatus for stamping out sheet material blanks, comprising first means for cutting only partly through a sheet material at a first location along the outlines of a blank to be stamped, and for therefor advancing with the sheet material without displacement of said sheet material and said first means relative to each other to a second location; second means cooperating at said second location with said first means for completely severing said blank from the surrounding sheet material by cutting all the way through the latter; and third means for removing the blank and the surrounding sheet material separately from one another.

7. Apparatus as defined in claim 6, wherein said third means comprises a suction device for removing said blank.

* * * * *